US012753944B2

(12) United States Patent
Nakazawa et al.

(10) Patent No.: US 12,753,944 B2
(45) Date of Patent: Oct. 6, 2026

(54) HEAT EXCHANGER, VENTILATOR, AND METHOD FOR MANUFACTURING HEAT EXCHANGER

(71) Applicant: DAIKIN INDUSTRIES, LTD., Osaka (JP)

(72) Inventors: Takema Nakazawa, Osaka (JP); Masaya Kasai, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 85 days.

(21) Appl. No.: 18/748,866

(22) Filed: Jun. 20, 2024

(65) Prior Publication Data

US 2024/0337409 A1 Oct. 10, 2024

Related U.S. Application Data

(63) Continuation of application No. PCT/JP2022/047887, filed on Dec. 26, 2022.

(30) Foreign Application Priority Data

Dec. 27, 2021 (JP) ..... 2021-212114

(51) Int. Cl.
*F24F 12/00* (2006.01)

(52) U.S. Cl.
CPC ..... *F24F 12/006* (2013.01)

(58) Field of Classification Search
CPC ..... F24F 12/002; F24F 12/006
USPC ..... 165/10, 110, 166
See application file for complete search history.

(56) References Cited

U.S. PATENT DOCUMENTS

| | | | | |
|---|---|---|---|---|
| 6,293,337 | B1 * | 9/2001 | Strahle | F28F 3/044 165/165 |
| 10,962,252 | B2 * | 3/2021 | LePoudre | F24F 3/147 |
| 11,768,037 | B2 * | 9/2023 | Yamakoshi | F28F 9/0275 165/166 |
| 12,305,934 | B2 * | 5/2025 | Kasai | F28D 21/0014 |
| 12,352,459 | B2 * | 7/2025 | Bahar | F28D 21/0014 |
| 12,385,654 | B2 * | 8/2025 | LePoudre | F24F 3/1417 |
| 12,480,722 | B2 * | 11/2025 | Kasai | F28D 9/0068 |
| 2008/0283217 | A1 * | 11/2008 | Gagnon | F24F 12/006 165/166 |

(Continued)

FOREIGN PATENT DOCUMENTS

| | | | |
|---|---|---|---|
| JP | 7-208891 | A | 8/1995 |
| JP | 2015-529787 | A | 10/2015 |

(Continued)

OTHER PUBLICATIONS

International Preliminary Report of corresponding PCT Application No. PCT/JP2022/047887 dated Jul. 11, 2024.

(Continued)

*Primary Examiner* — Claire E Rojohn, III
(74) *Attorney, Agent, or Firm* — Spencer Fane LLP

(57) ABSTRACT

A heat exchanger includes a plurality of flow pass elements. Each flow pass element includes a partition member that is a moisture permeable sheet shaped member, and a frame forming an air flow path by joining to the partition member. The heat exchanger is configured by stacking the plurality of flow pass elements. In each of the plurality of flow pass elements, the partition member is joined to the frame in direction contact.

9 Claims, 10 Drawing Sheets

(56) References Cited

U.S. PATENT DOCUMENTS

2010/0025026 A1* 2/2010 Dietz ..... F28F 9/026 165/166
2011/0048388 A1* 3/2011 Takahashi ..... B01J 37/0242 165/10
2011/0192579 A1* 8/2011 Sotokawa ..... F28D 21/0015 165/166
2012/0073791 A1* 3/2012 Dubois ..... B01D 67/0002 96/9
2012/0205081 A1* 8/2012 Terai ..... F28D 9/0025 156/60
2014/0014289 A1* 1/2014 Tan ..... F28D 9/0025 165/10
2016/0177512 A1* 6/2016 Kawahara ..... C12M 23/20 162/158
2017/0138630 A1* 5/2017 Yagi ..... F24F 12/006
2019/0257032 A1* 8/2019 Kawahara ..... D21H 11/18
2021/0010759 A1* 1/2021 Tan ..... C08F 293/00
2022/0026165 A1* 1/2022 Kasai ..... F28D 9/0068
2022/0055160 A1* 2/2022 Nakazawa ..... F28D 21/0014
2022/0057146 A1* 2/2022 Nakazawa ..... F28D 9/0062
2023/0129711 A1* 4/2023 Nishio ..... C08J 9/365 165/164
2023/0204307 A1* 6/2023 Nakazawa ..... F28D 9/0062 165/134.1
2023/0213291 A1* 7/2023 Kasai ..... F28D 9/0068 165/166
2024/0337409 A1* 10/2024 Nakazawa ..... F24F 12/006

FOREIGN PATENT DOCUMENTS

JP 2020051655 A * 4/2020
JP 2021-162295 A 10/2021
WO WO-2014109184 A1 * 7/2014 ..... F28F 9/0075

OTHER PUBLICATIONS

International Search Report of corresponding PCT Application No. PCT/JP2022/047887 dated Feb. 14, 2023.
European Search Report of corresponding EP Application No. 22 91 6011.4 dated Feb. 24, 2025.

* cited by examiner

HEAT EXCHANGER, VENTILATOR, AND METHOD FOR MANUFACTURING HEAT EXCHANGER

CROSS-REFERENCE TO RELATED APPLICATIONS

This is a continuation of Application No. PCT/JP2022/047887 filed on Dec. 26, 2022, which claims priority to Japanese Patent Application No. 2021-212114, filed on Dec. 27, 2021. The entire disclosures of these applications are incorporated by reference herein.

BACKGROUND

Technical Field

The present disclosure relates to a heat exchanger, a ventilator, and a method for manufacturing the heat exchanger.

Background Art

Japanese Unexamined Patent Publication No. H7-208891 discloses a heat exchanger configured to exchange heat between two different kinds of air. In this heat exchanger, an interval between partition plates stacked is maintained by separation plates. The partition plates and the separation plates are adhered to each other with an adhesive.

SUMMARY

A first aspect of the present disclosure is directed to a heat exchanger including a plurality of flow pass elements. Each flow pass element includes a partition member that is a moisture permeable sheet shaped member, and a frame forming an air flow path by joining to the partition member. The heat exchanger is configured by stacking the plurality of flow pass elements. In each of the plurality of flow pass elements, the partition member is joined to the frame in direct contact.

DETAILED DESCRIPTION OF EMBODIMENT(S)

Embodiments will be described below. A ventilator (100) of this embodiment includes a heat exchanger (10) and configured to supply air to and exhaust air from an indoor space.

Ventilator

Figure 1:
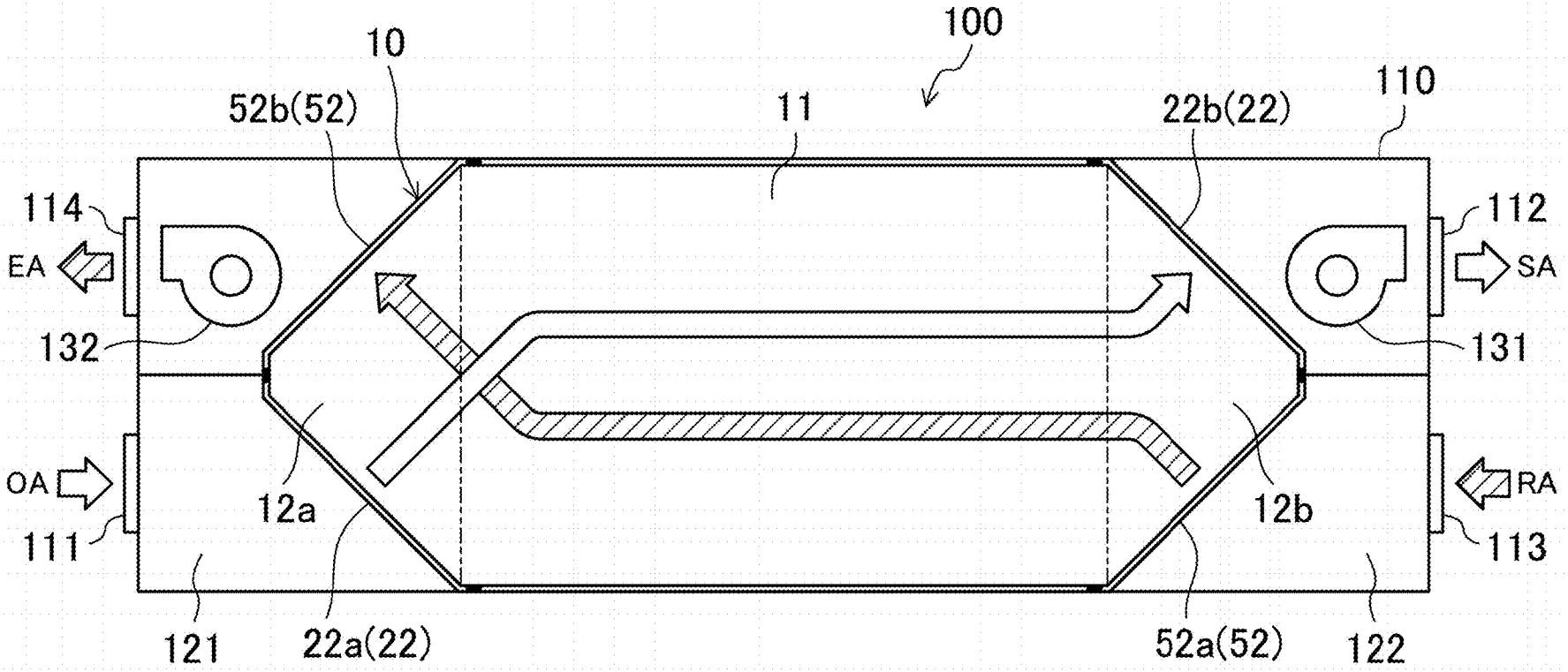
FIG. 1 is a schematic diagram illustrating a ventilator.

As illustrated in FIG. 1, the ventilator (100) includes a casing (110) that houses the heat exchanger (10). The casing (110) includes an outdoor air inlet (111), an air supply port (112), an indoor air inlet (113), and an exhaust port (114). In the internal space of the casing (110), an air supply passage (121) and an exhaust passage (122) are formed.

The air supply passage (121) has two ends respectively connected to the outdoor air inlet (111) and the air supply port (112). The exhaust passage (122) has two ends respectively connected to the indoor air inlet (113) and the exhaust port (114). In the ventilator (100), outdoor air flows through the air supply passage (121) toward the inside of the room, and room air flows through the exhaust passage (122) toward the outside of the room.

The heat exchanger (10) is located to intersect the air supply passage (121) and the exhaust passage (122). The heat exchanger (10) is disposed in the casing (110) such that the first passage (21) communicates with the air supply passage (121) and the second passage (51) communicates with the exhaust passage (122).

The ventilator (100) further includes an air supply fan (131) and an exhaust fan (132). The air supply fan (131) is disposed downstream of the heat exchanger (10) in the air supply passage (121). The exhaust fan (132) is disposed downstream of the heat exchanger (10) in the exhaust passage (122).

General Configuration of Heat Exchanger

A heat exchanger (10) of this embodiment is a so-called total heat exchanger. In the ventilator (100), this heat exchanger (10) causes outdoor air (supply air) supplied into a room and room air (exhaust air) exhausted out of the room to exchange sensible heat and latent heat (moisture).

Figure 2:
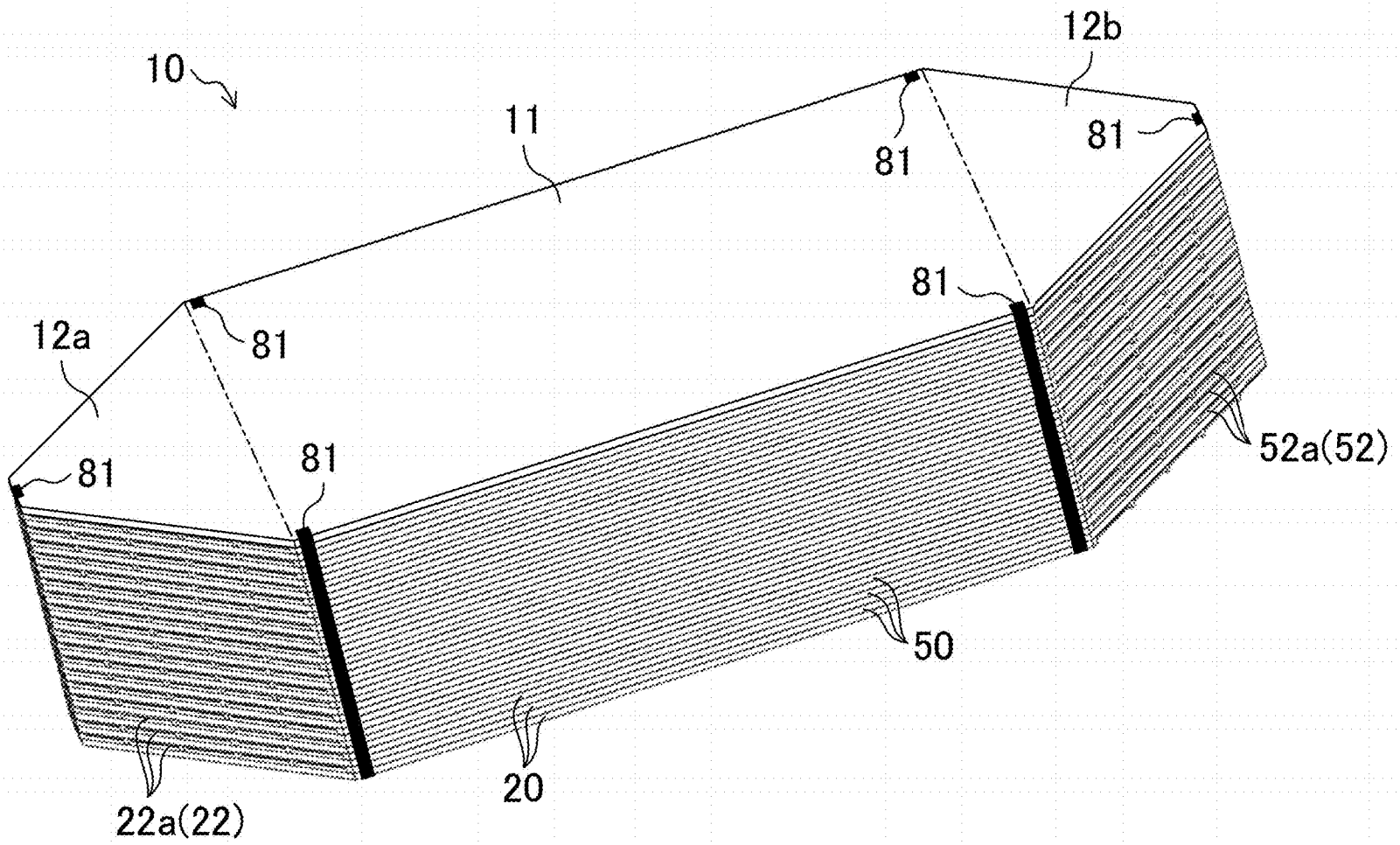
FIG. 2 is a perspective view of a heat exchanger.
Figure 3:
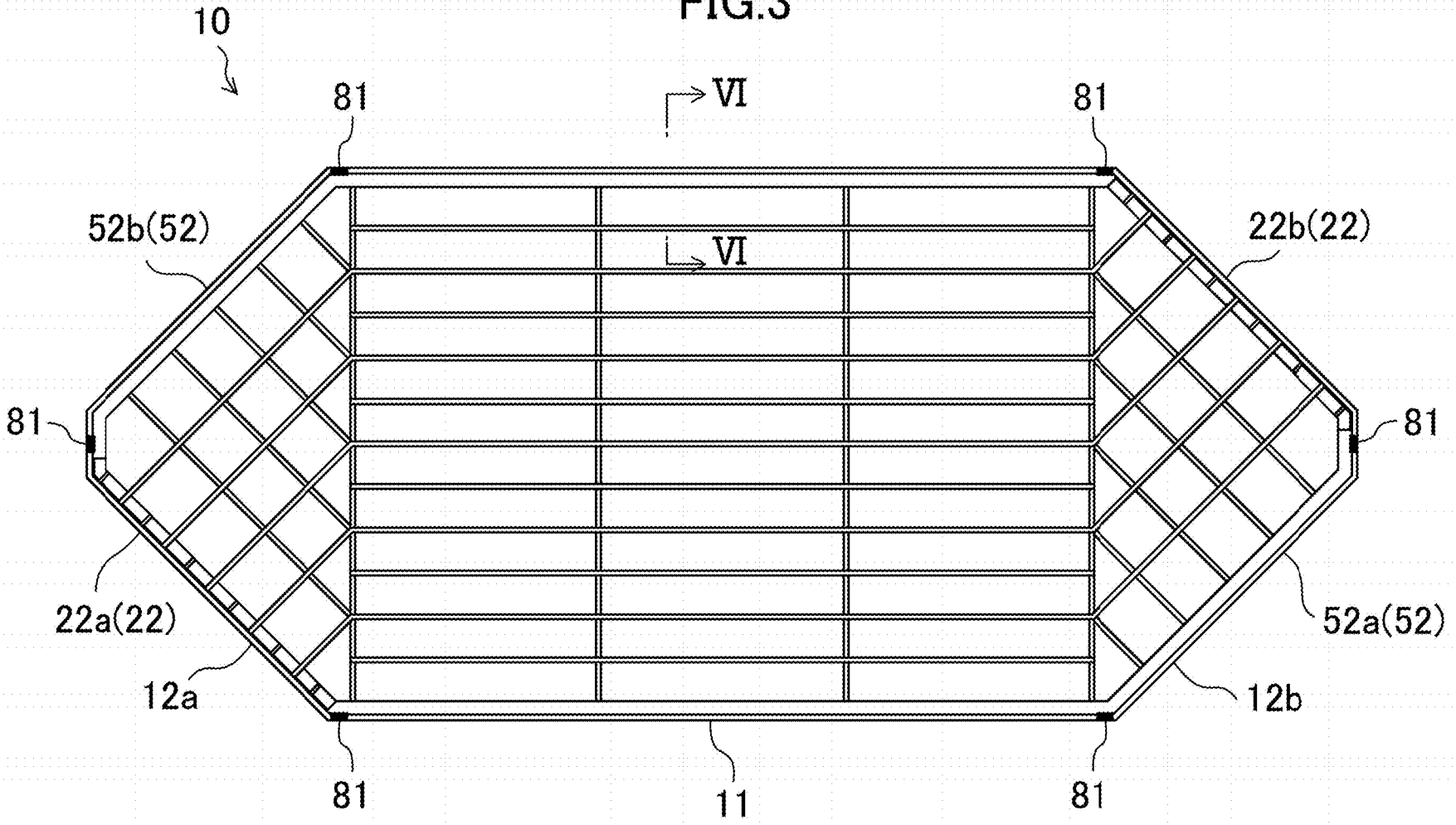
FIG. 3 is a plan view of the heat exchanger.

As illustrated in FIGS. 2 and 3, the heat exchanger (10) is formed in a prism shape having polygonal end faces. Each end face of the heat exchanger (10) of this embodiment has a horizontally oriented octagonal shape. The heat exchanger (10) includes a main heat exchange section (11) and two auxiliary heat exchange sections (12*a*, 12*b*).

The main heat exchange section (11) is located at the middle of the heat exchanger (10) in the right-to-left direction in FIG. 3. When the heat exchanger (10) is viewed in plan as illustrated in FIG. 3, the main heat exchange section (11) is a horizontally oriented rectangular portion. The auxiliary heat exchange sections (12*a*, 12*b*) are portions of the heat exchanger (10) located on the sides of the main heat exchange section (11) in the right-to-left direction in FIG. 3. In the heat exchanger (10), the auxiliary heat exchange sections (12*a*, 12*b*) are arranged on the respective sides of the main heat exchange section (11) in the right-to-left direction in FIG. 3. In the plan view of the heat exchanger (10) illustrated in FIG. 3, each of the auxiliary heat exchange section (12*a*, 12*b*) is a trapezoidal portion.

The heat exchanger (10) includes a plurality of first elements (20) and a plurality of second elements (50). The first elements (20) and the second elements (50) are flow path elements. The first elements (20) and the second elements (50) are alternately stacked in the heat exchanger (10). Each of the first elements (20) forms a first passage (21). The first passage (21) is an air flow path which allows supply air to flow therethrough. Each of the second elements (50) forms a second passage (51). The second passage (51) is an air flow path which allows exhaust air to flow therethrough. In the heat exchanger (10), the first passages (21) and the second passages (51) are alternately formed in the stacking direction of the first elements (20) and the second elements (50).

The heat exchanger (10) has a first inflow port (22*a*), a first outflow port (22*b*), a second inflow port (52*a*), and a second outflow port (52*b*) which are formed in side surfaces thereof (surfaces parallel to the stacking direction of the first elements (20) and the second elements (50)). The first inflow port (22*a*) and the first outflow port (22*b*) are formed in the first element (20) and communicate with the first passage (21). The second inflow port (52*a*) and the second outflow port (52*b*) are formed in the second element (50) and communicate with the second passage (51).

The first inflow port (22*a*), the first outflow port (22*b*), the second inflow port (52*a*), and the second outflow port (52*b*) are formed on different side surfaces of the heat exchanger (10). In one of the auxiliary heat exchange sections (12*a*) of the heat exchanger (10), the first inflow port (22*a*) is open on one side surface, and the second outflow port (52*b*) is open on a different side surface. In the other auxiliary heat exchange section (12*b*) of the heat exchanger (10), the first outflow port (22*b*) is open on one side surface, and the second inflow port (52*a*) is open on a different side surface.

The side surfaces of the heat exchanger (10) are formed by the outer peripheral surface of a stack of the first elements (20) and the second elements (50). The side surfaces of the heat exchanger (10) are substantially flat surfaces.

The first elements (20) and the second elements (50) constituting the heat exchanger (10) each have six notches (38, 68). In each of the elements (20, 50), the notches (38, 68) open on the outer peripheral surface of the element (20, 50).

The notches (38, 68) provided in one element (20, 50) correspond to the respective notches (38, 68) of each of the other elements (20, 50). In the heat exchanger (10), corresponding notches (38, 68) in the elements (20, 50) are aligned in a row in the stacking direction of the elements (20, 50).

The heat exchanger (10) of this embodiment is provided with seals (81) so as to fill notches (38, 68) aligned in a row. The seals (81) are formed by filling the notches (38, 68) aligned in a row with a filler such as a silicon sealing agent and solidifying the filler.

Heat Exchange Action of Heat Exchanger

As illustrated in FIG. 1, into the heat exchanger (10), outdoor air OA flows through the first inflow port (22*a*), and room air RA flows through the second inflow port (52*a*). The outdoor air OA that has entered the first inflow port (22*a*) flows through the first passage (21) as the supply air, passes through the one auxiliary heat exchange section (12*a*), the main heat exchange section (11), and the other auxiliary heat exchange section (12*b*) in this order, and is supplied into the room through the first outflow port (22*b*). The room air RA that has flowed into the second inflow port (52*a*) flows through the second passage (51) as the exhaust air, passes through the other auxiliary heat exchange section (12*b*), the main heat exchange section (11), and the one auxiliary heat exchange section (12*a*) in this order, and is discharged to the outside of the room through the second outflow port (52*b*).

In each of the auxiliary heat exchange sections (12*a*, 12*b*) of the heat exchanger (10), the supply air in the first passage (21) and the exhaust air in the second passage (51) flow in directions intersecting with each other. In the main heat exchange section (11) of the heat exchanger (10), the supply air in the first passage (21) and the exhaust air in the second passage (51) flow in opposite directions.

The heat exchanger (10) causes the supply air flowing through the first passage (21) and the exhaust air flowing through the second passage (51) to exchange sensible heat and latent heat (moisture). Of the supply air and the exhaust air in the heat exchanger (10), one with the higher temperature transfers heat to the other with the lower temperature. Further, of the supply air and the exhaust air in the heat exchanger (10), one with the higher humidity transfers moisture to the other with the lower humidity.

First Element, Second Element

Figure 6:
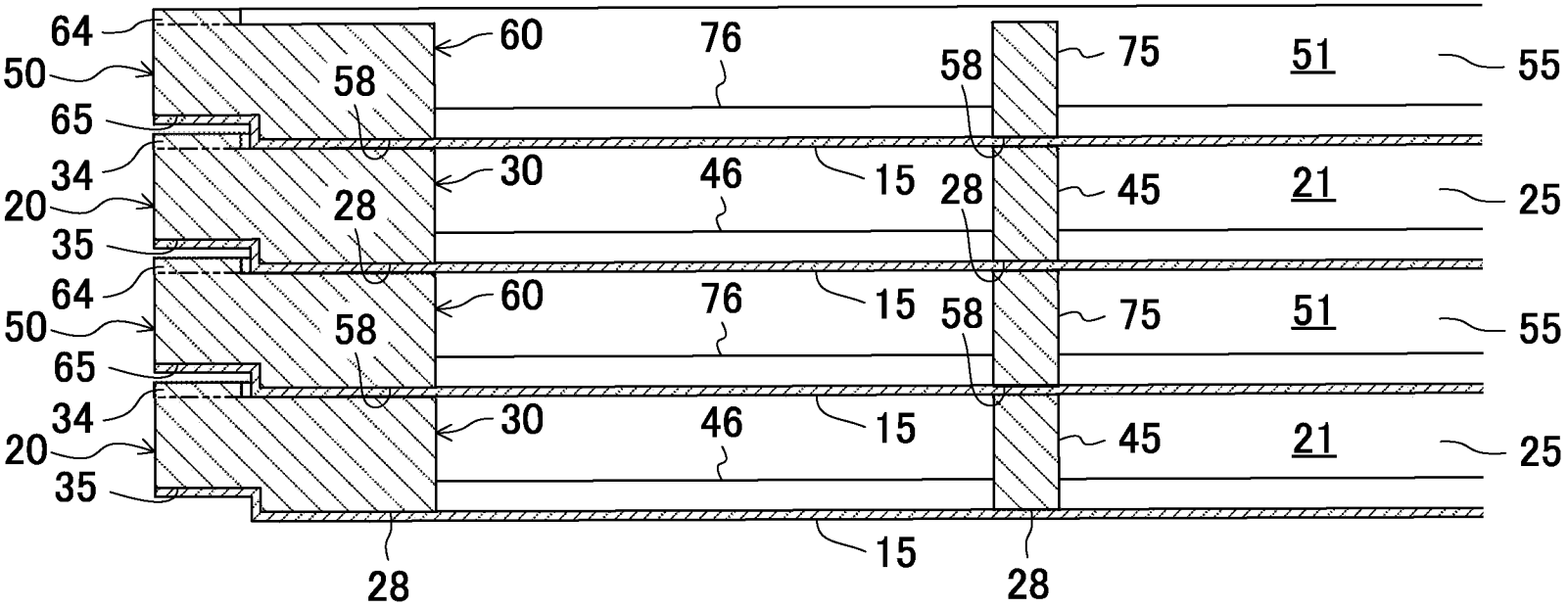
FIG. 6 is a cross-sectional view of portion of the heat exchanger taken along line VI-VI in FIG. 3.
Figure 7:
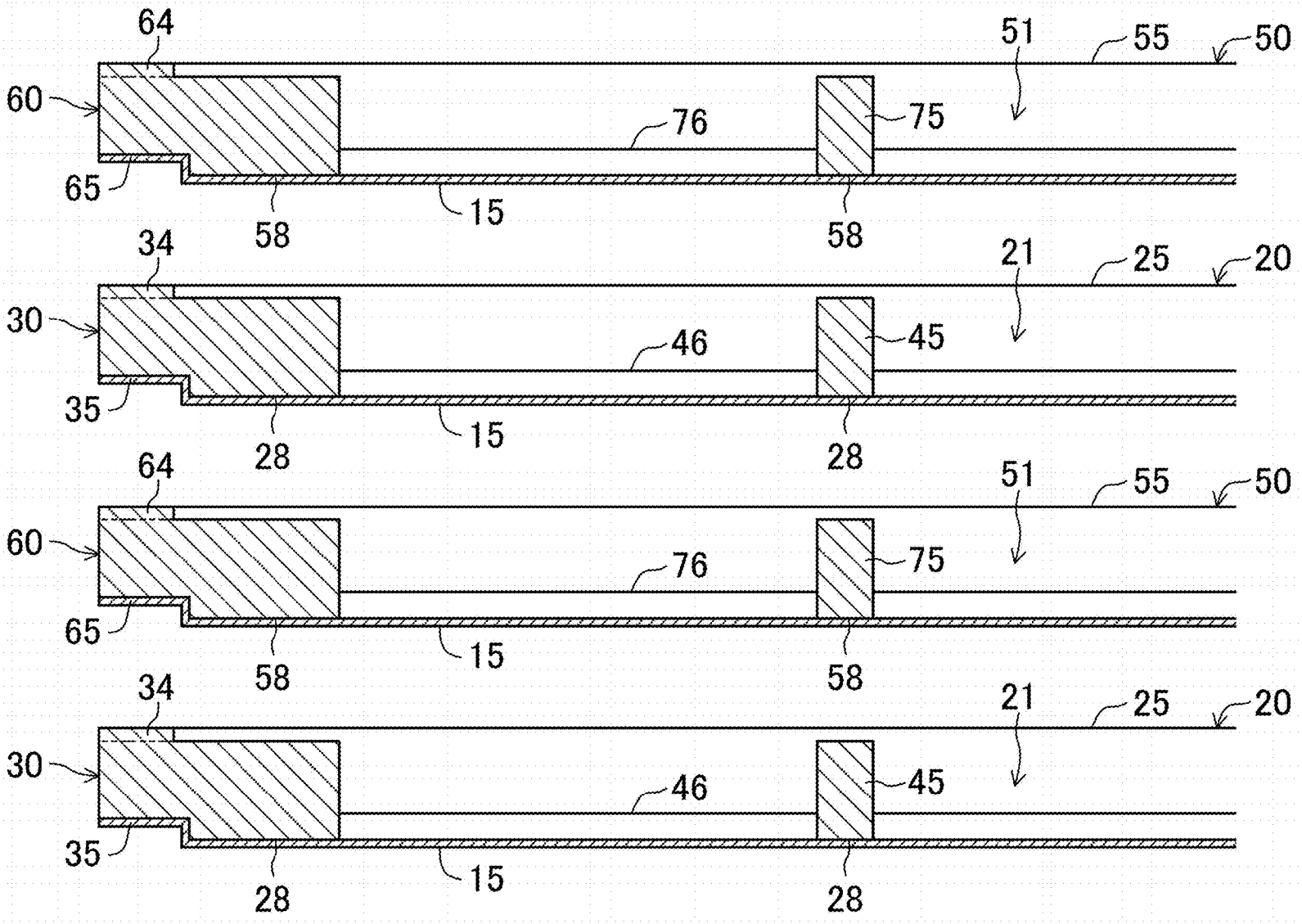
FIG. 7 is a cross-sectional view corresponding to FIG. 6 with first elements and second elements separated from each other.

As illustrated in FIGS. 6 and 7, the first element (20) includes a first frame (25) and a partition sheet (15), and the second element (50) includes a second frame (55) and a partition sheet (15).

Each of the first frame (25) and the second frame (55) is a grid-like member. In the following description, the upper surfaces of the first frame (25) and the second frame (55) in FIGS. 6 and 7 will be referred to as "front surfaces," and the lower surfaces of the first frame (25) and the second frame (55) in FIGS. 6 and 7 will be referred to as "back surfaces."

The first element (20) includes the partition sheet (15) bonded to a back surface of the first frame (25). The partition sheet (15) covers substantially the entire back surface of the first frame (25). The second element (50) includes the partition sheet (15) bonded to a back surface of the second frame (55). The partition sheet (15) covers substantially the entire back surface of the second frame (55).

First Frame

Figure 4:
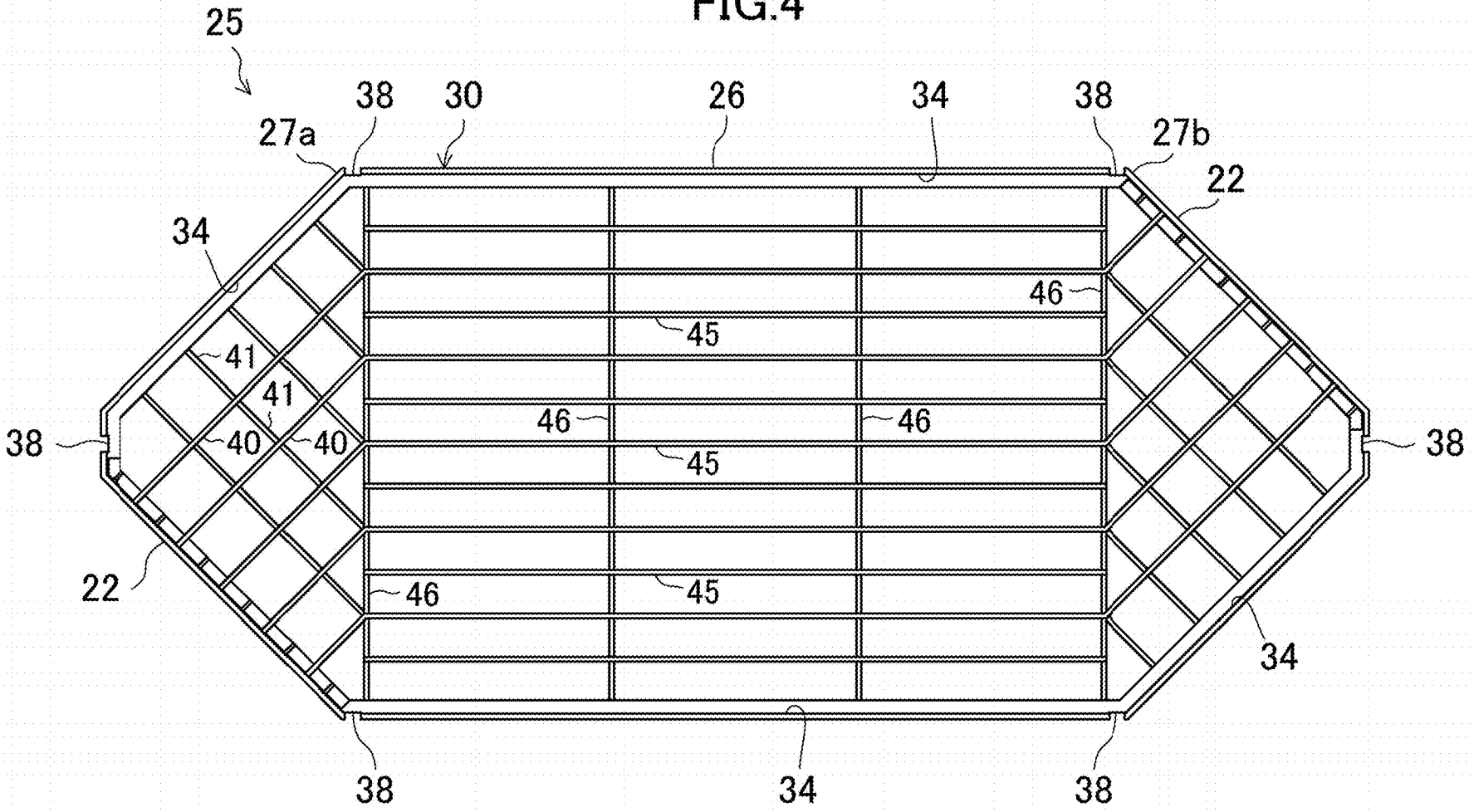
FIG. 4 is a plan view of a first frame according to the heat exchanger.

As illustrated in FIG. 4, the first frame (25) is formed in a horizontally oriented octagonal shape in plan view. The first frame (25) has substantially the same outer shape as the end faces of the heat exchanger (10) in plan view. The first frame (25) is a first spacing member that keeps a space between an adjacent pair of the partition sheets (15). The first frame (25) is made of a resin. The first frame (25) is formed by injection molding.

The first frame (25) has a single middle area (26) and two end areas (27*a*, 27*b*). The middle area (26) is a horizontally oriented rectangular area, and is located at the middle in the right-to-left direction in FIG. 4. The first frame (25) has the end areas (27*a*, 27*b*) formed on both sides of the middle area (26). The end areas (27*a*, 27*b*) are trapezoidal areas located on the sides of the middle area (26) in the right-to-left direction in FIG. 4.

The first frame (25) includes a frame portion (30). The frame portion (30) is a portion extending along the outer periphery of the first frame (25) over the entire perimeter of the first frame (25). The frame portion (30) extends along the periphery of the partition sheet (15).

The frame portion (30) of the first frame (25) has two first communication openings (22). Each first communication opening (22) provided in each frame portion (30) allows the first passage (21) surrounded by the frame portion (30) to communicate with the outside of the frame portion (30). In the frame portion (30) illustrated in FIG. 4, one of the first communication openings (22) is formed on the downward oblique side of the left end area (27*a*), and constitutes the first inflow port (22*a*). Also in the frame portion (30) illustrated in FIG. 4, the other first communication opening (22) is formed on the upward oblique side of the right end area (27*b*), and constitutes the first outflow port (22*b*).

As illustrated in FIG. 6, a ridge (34) is provided in the frame portion (30). The ridge (34) extends along the outermost peripheral edge of the frame portion (30) and protrudes from the front surface of the frame portion (30). The front surface of the frame portion (30) and the end face of the ridge (34) are flat surfaces substantially orthogonal to the thickness direction of the frame portion (30).

As illustrated in FIG. 6, an elongated recess (35) is provided in the frame portion (30). The elongated recess (35) is provided along the outermost peripheral edge of the frame portion (30). The elongated recess (35) is open on both of the back surface and the outer peripheral surface of the frame portion (30). The back surface of the frame portion (30) and the bottom surface of the elongated recess (35) are flat surfaces substantially orthogonal to the thickness direction of the frame portion (30).

The cross-sectional shape of the elongated recess (35) corresponds to the cross-sectional shape of a ridge (64), which will be described later, of the second frame (55). The ridge (64) of the second frame (55) fits into the elongated recess (35) of the first frame (25).

As illustrated in FIG. 4, the frame portion (30) of the first frame (25) has six first notches (38). Each of the first notches (38) is open on the outer peripheral surface of the frame portion (30), and extending toward inside of the frame portion (30).

The first frame (25) includes first inner ribs (40) and first holding ribs (41). The first inner ribs (40) and the first holding ribs (41) are provided in each end area (27*a*, 27*b*) of the first frame (25).

Each of the first inner ribs (40) is formed in a straight bar shape, and extends in a direction intersecting with the first communication opening (22). In this embodiment, the height of the first inner ribs (40) is substantially equal to the thickness of the first passage (21).

Each of the first holding ribs (41) is formed in a straight bar shape, and extends in a direction substantially orthogonal to the first inner ribs (40). Each of the first holding ribs (41) extends from one of an adjacent pair of the first inner ribs (40) to the other. Each of the first holding ribs (41) is less than half as thick as the first inner ribs (40).

The first frame (25) includes intra-first passage ribs (45) and first support ribs (46). The intra-first passage ribs (45) and the first support ribs (46) are provided in the middle area (26) of the first frame (25).

Each of the intra-first passage ribs (45) is formed in a straight bar shape, and extends in a direction parallel to the long side of the middle area (26). The height of the intra-first passage ribs (45) is substantially equal to the thickness of the first passage (21).

Each of the first support ribs (46) is formed in a straight bar shape, and extends in a direction substantially orthogonal to the intra-first passage ribs (45). Each of the first support ribs (46) is provided to extend from one of an adjacent pair of the intra-first passage ribs (45) to the other. The first support ribs (46) are integral with the intra-first passage ribs (45), and keep a space between an adjacent pair of the intra-first passage ribs (45). Each of the first support ribs (46) is less than half as thick as the intra-first passage ribs (45).

As illustrated in FIGS. 6 and 7, the partition sheet (15) is bonded to the back surface of the first frame (25). Specifically, in the first frame (25), the back surfaces of the frame portion (30), the first inner ribs (40), the first holding ribs (41), the intra-first passage ribs (45), and the first support ribs (46) constitute a joining surface (28), the partition sheet (15) is joined to this joining surface (28). The joining surface (28) of the first frame (25) is a flat surface.

Second Frame

Figure 5:
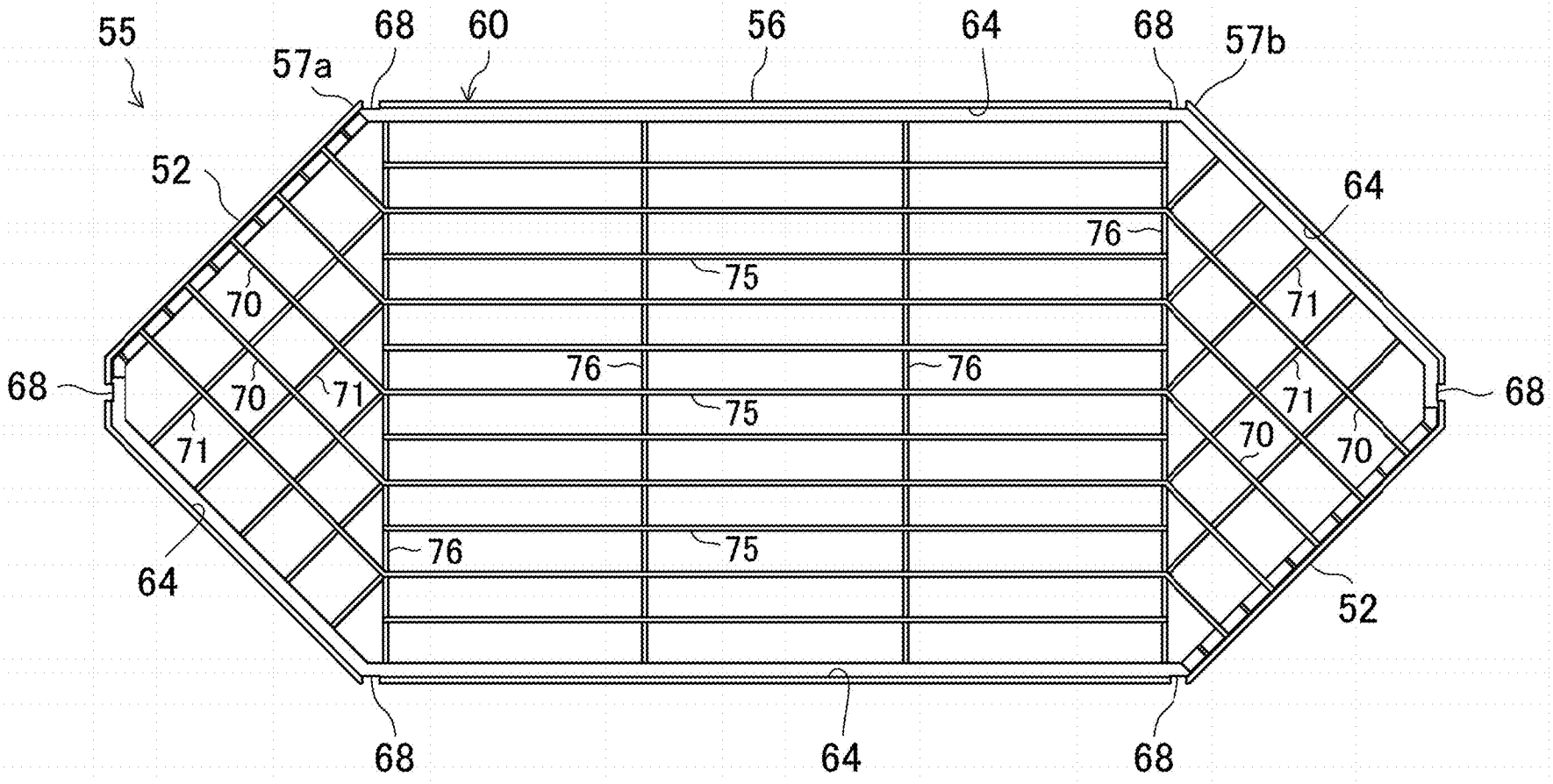
FIG. 5 is a plan view of a second frame of the heat exchanger.

As illustrated in FIG. 5, the second frame (55) is formed in a horizontally oriented octagonal shape in plan view. The second frame (55) has substantially the same outer shape as the end faces of the heat exchanger (10) in plan view. The second frame (55) is a second spacing member that keeps a space between an adjacent pair of the partition sheets (15). The second frame (55) is made of a resin. The second frame (55) is formed by injection molding.

The second frame (55) has a single middle area (56) and two end areas (57*a*, 57*b*). The middle area (56) is a horizontally oriented rectangular area, and is located at the middle in the right-to-left direction in FIG. 5. In the second frame (55), the end areas (57*a*, 57*b*) are provided on both sides of the middle area (56). The end areas (57*a*, 57*b*) are trapezoidal areas located on the sides of the middle area (56) in the right-to-left direction in FIG. 5.

The second frame (55) includes a frame portion (60). The frame portion (60) is a portion extending along the outer periphery of the second frame (55) over the entire perimeter of the second frame (55). The frame portion (60) extends along the periphery of the partition sheet (15).

The frame portion (60) of the second frame (55) has two second communication openings (52). Each second communication opening (52) provided in each frame portion (60) allows the second passage (51) surrounded by the frame portion (60) to communicate with the outside of the frame portion (60). In the frame portion (60) illustrated in FIG. 5, one of the second communication openings (52) is formed on the upward oblique side of the left end area (57*a*), and constitutes the second outflow port (52*b*). Also in the frame portion (60) illustrated in FIG. 5, the other second communication opening (52) is formed on the downward oblique side of the right end area (57*b*), and constitutes the second inflow port (52*a*).

As illustrated in FIG. 6, a ridge (64) is provided in the frame portion (60). The ridge (64) extends along the outermost peripheral edge of the frame portion (60) and protrudes from the front surface of the frame portion (60). The front surface of the frame portion (60) and the end face of the ridge (64) are flat surfaces substantially orthogonal to the thickness direction of the frame portion (60).

As illustrated in FIG. 6, an elongated recess (65) is provided in the frame portion (60). The elongated recess (65) is provided along the outermost peripheral edge of the frame portion (60). The elongated recess (65) is open on both of the back surface and the outer peripheral surface of the frame portion (60). The back surface of the frame portion (60) and the bottom surface of the elongated recess (65) are flat surfaces substantially orthogonal to the thickness direction of the frame portion (60).

The cross-sectional shape of the elongated recess (65) corresponds to the cross-sectional shape of the ridge (34) of the first frame (25). The ridge (34) of the first frame (25) fits into the elongated recess (65) of the second frame (55).

As illustrated in FIG. 5, the frame portion (60) of the second frame (55) has six second notches (68). Each of the second notches (68) is open on the outer peripheral surface of the frame portion (60), and extending toward inside of the frame portion (60). The second notch (68) has the same shape as the first notch (38).

The second frame (55) includes second inner ribs (70) and second holding ribs (71). The second inner ribs (70) and the second holding ribs (71) are provided in each end area (57*a*, 57*b*) of the second frame (55).

Each of the second inner ribs (70) is formed in a straight bar shape, and extends in a direction intersecting with the second communication opening (52). In this embodiment, the height of the second inner ribs (70) is substantially equal to the thickness of the second passage (51).

Each of the second holding ribs (71) is formed in a straight bar shape, and extends in a direction substantially orthogonal to the second inner ribs (70). Each of the second holding ribs (71) is provided to extend from one of an adjacent pair of the second inner ribs (70) to the other. Each of the second holding ribs (71) is less than half as thick as the second inner ribs (70).

The second frame (55) includes intra-second passage ribs (75) and second support ribs (76). The intra-second passage ribs (75) and the second support ribs (76) are provided in the middle area (56) of the second frame (55).

Each of the intra-second passage ribs (75) is formed in a straight bar shape, and extends in a direction parallel to the long side of the middle area (56). The height of the intra-second passage ribs (75) is substantially equal to the thickness of the second passage (51).

Each of the second support ribs (76) is formed in a straight bar shape, and extends in a direction substantially orthogonal to the intra-second passage ribs (75). Each of the second support ribs (76) is provided to extend from one of an adjacent pair of the intra-second passage ribs (75) to the other. The second support ribs (76) are integral with the intra-second passage ribs (75), and keep a space between the adjacent pair of the intra-second passage ribs (75). Each of the second support ribs (76) is less than half as thick as the intra-second passage ribs (75).

As illustrated in FIGS. 6 and 7, the partition sheet (15) is bonded to the back surface of the second frame (55). Specifically, in the second frame (55), the back surfaces of the frame portion (60), the second inner ribs (70), the second holding ribs (71), the intra-second passage ribs (75), and the second support ribs (76) constitute a joining surface (58), and the partition sheet (15) is joined to this joining surface (58). The joining surface (58) of the second frame (55) is a flat surface.

Partition Sheet

Figure 8:
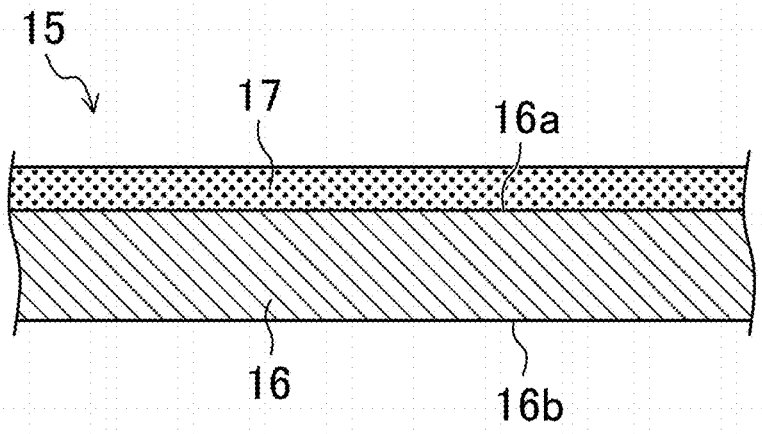
FIG. 8 is a cross-sectional view of a partition sheet of the heat exchanger.

As illustrated in FIG. 8, the partition sheet (15) includes a sheet-like porous base (16) and a moisture permeable layer (17) provided on the porous base (16). The porous base (16) has a first surface (16*a*) and a second surface (16*b*). In the partition sheet (15) of this embodiment, the moisture permeable layer (17) is provided to cover the first surface (16*a*) of the porous base (16).

Porous Base

The porous base (16) is a porous, sheet-like member made of polyolefin-based resin, for example. The porous base (16) may be non-woven fabric made of fibrous resin. The porous base (16) has a thickness of 10 μm, for example. Preferably, the porous base (16) is an element that serves as a support for the moisture permeable layer (17), and exhibits excellent moisture permeability.

The first surface (16*a*), i.e., one of the surfaces of the porous base (16), is subjected to hydrophilic treatment. Examples of the hydrophilic treatment include corona discharge treatment and plasma treatment. The hydrophilic treatment allows generation of a carboxy group, a hydroxy group, or a carbonyl group on the first surface (16*a*) of the porous base (16).

Moisture Permeable Layer

The moisture permeable layer (17) is a coating covering the entirety of the first surface (16*a*) of the porous base (16). The moisture permeable layer (17) is made of a polymer having moisture permeability. The polymer forming the moisture permeable layer (17) is a copolymer having a first constitutional unit and a second constitutional unit. The moisture permeable layer (17) has a thickness of 1 μm, for example. The thickness of the moisture permeable layer (17) is not particularly limited, and is preferably 0.05 μm to 1 μm, more preferably 0.1 μm to 0.5 μm. In a case where the thickness of the moisture permeable layer (17) is 0.05 μm or more, favorable film formability is exhibited, leading to improvement in gas barrier properties. In a case where the above-described thickness is 1 μm or less, more favorable moisture permeability is exhibited.

Examples of monomer forming the first constitutional unit may include 2-methacryloyloxyethyl phosphorylcholine. Examples of monomer forming the second constitutional unit may include (meth)acrylic acid alkyl ester having an alkyl group with a carbon number of 2 or more in an ester moiety, such as (meth)acrylic acid stearyl. In the copolymer forming the moisture permeable layer (17), the form of copolymer having the first constitutional unit and the second constitutional unit is not particularly limited, and the copolymer forming the moisture permeable layer (17) may be any of a block copolymer, an alternating copolymer, and a random copolymer.

Method for Forming Moisture Permeable Layer

A step of forming a moisture permeable layer (17) on a porous base (16) includes an applying step and a heating-drying step. The applying step is a step of applying a raw material liquid for forming a moisture permeable layer (17) to a first surface (16*a*) of the porous base (16). The heating-drying step is a step of heating a coating film formed in the applying step to evaporate the solvent.

The raw material liquid used in the applying step is a liquid obtained by diluting a stock solution with water. The stock solution is a mixture of a polymer forming the moisture permeable layer (17) and a solvent (ethanol in this embodiment). Thus, the raw material liquid of this embodiment is a liquid containing, as main components, a polymer forming a moisture permeable layer (17), and ethanol and water as solvents. The polymer forming the moisture permeable layer (17) is a first substance. Main components of the solvents composing the raw material liquid is ethanol and water. The solvent may contain a sub-component such as an additive. Ethanol, which is a main component of the solvent, is a second substance. The polymer, which is the first substance, is dissolved in ethanol, which is the second substance.

As mentioned above, in the applying step, the raw material liquid is applied to the first surface (16*a*) of the porous base (16). The first surface (16*a*) of the porous base (16) is subjected to a hydrophilic treatment in advance. Thus, the thickness of the coating formed on the first surface (16*a*) becomes uniform. The moisture permeable layer (17) with an uniform thickness is formed accordingly.

Method for Manufacturing Heat Exchanger

Figure 9:
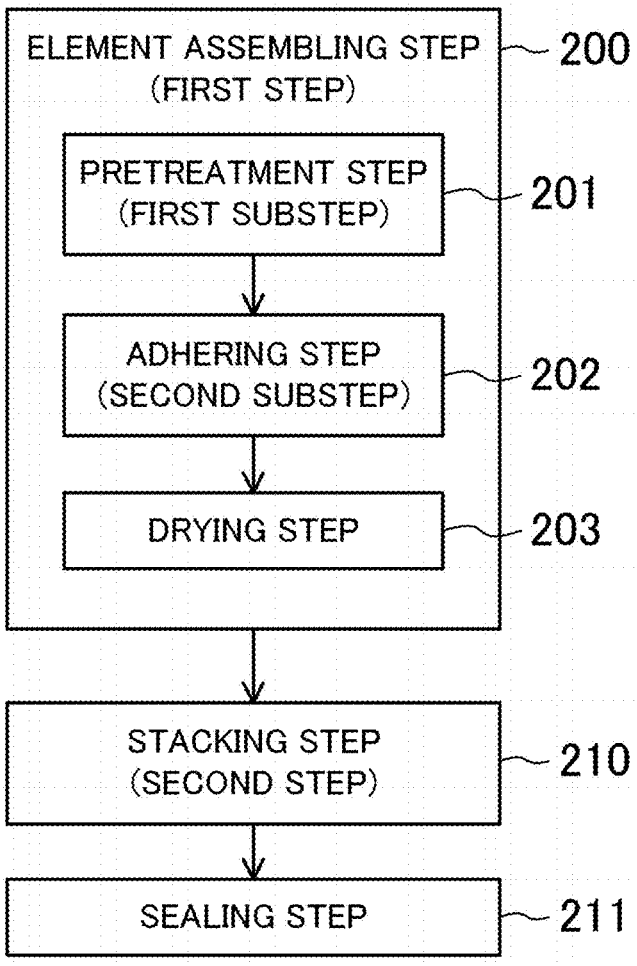
FIG. 9 is a flowchart of a method for manufacturing a heat exchanger.

A method for manufacturing the heat exchanger (10) will be described below. As illustrated in FIG. 9, in the method for manufacturing the heat exchanger (10) of this embodiment, an element assembling step (200), a stacking step (210), and a sealing step (211) are performed in this order.

Element Assembling Step

As illustrated in FIG. 9, the element assembling step (200) is a first step of assembling a first element (20) and a second element (50). In the element assembling step (200), a partition sheet (15) is joined to the first frame (25) and the second frame (55). In the element assembling step (200), a pretreatment step (201), an adhering step (202), and a drying step (203) are performed in this order.

Pretreatment Step of Element Assembling Step

The pretreatment step (201) is a first substep of causing a treatment liquid (250) to adhere to a joining surface (28, 58) of the frame (25, 55). In the pretreatment step (201), the treatment liquid (250) is sprayed or applied to the joining surface (28, 58) of the frame (25, 55).

The treatment liquid (250) contains ethanol and water as main components. The main components of the treatment liquid (250) include ethanol (second substance), which is a main component of the solvent of raw material liquid for forming a moisture permeable layer (17). The mixing ratio of ethanol and water in the treatment liquid (250) may be the same as or difference from the mixing ratio of ethanol and water in the solvent of the raw material liquid. The treatment liquid (250) may contain a sub-component such as an additive. The sub-component contained in the treatment liquid (250) may be the same as or different from the sub-component contained in the solvent of the raw material liquid.

Figure 10A:
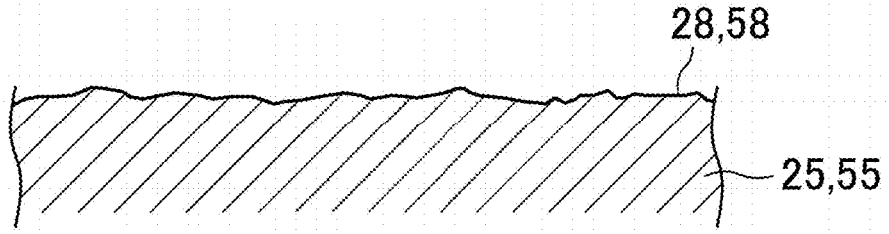
FIG. 10A, FIG. 10B, FIG. 10C and FIG. 10D show cross-sectional views of a frame and a partition sheet showing an element assembling step of the method for manufacturing a heat exchanger.
Figure 10B:
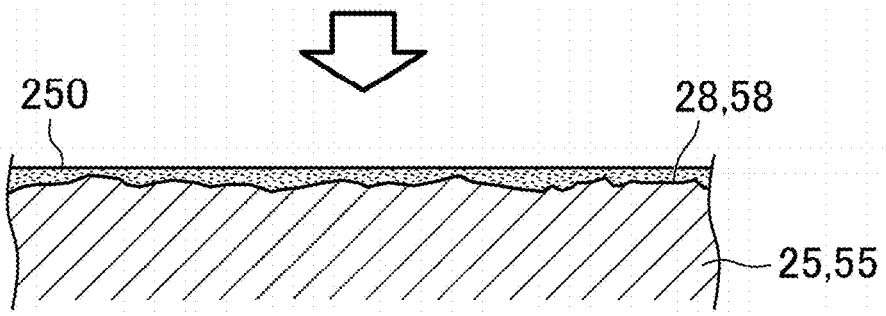

The joining surface (28, 58) of the frame (25, 55) is apparently flat. However, the frame (25, 55) is manufactured by injection molding, and the joining surface (28, 58) is not finished. Thus, as illustrated in FIG. 10A, fine irregularities are formed on the joining surface (28, 58). In the frame (25, 55) which has been subjected to the pretreatment step (201), as illustrated in FIG. 10B, the treatment liquid (250) is adhered to the joining surface (28, 58).

In the pretreatment step (201), the technique of causing the treatment liquid (250) to be adhered to the joining surface (28, 58) of the frame (25, 55) can be any of various techniques. For example, the treatment liquid (250) is adhered to the joining surface (28, 58) of the frame (25, 55) by using an instrument such as a spray gun, a roll coater, or a curtain coater. For example, an operator may use an instrument such as a spatula, a brush, and a hand roller to adhere the treatment liquid (250) to the joining surface (28, 58) of the frame (25, 55).

Adhering Step of Element Assembling Step

The adhering step (202) is a second substep of joining the partition sheet (15) to the joining surface (28, 58) of the frame (25, 55).

Figure 10C:
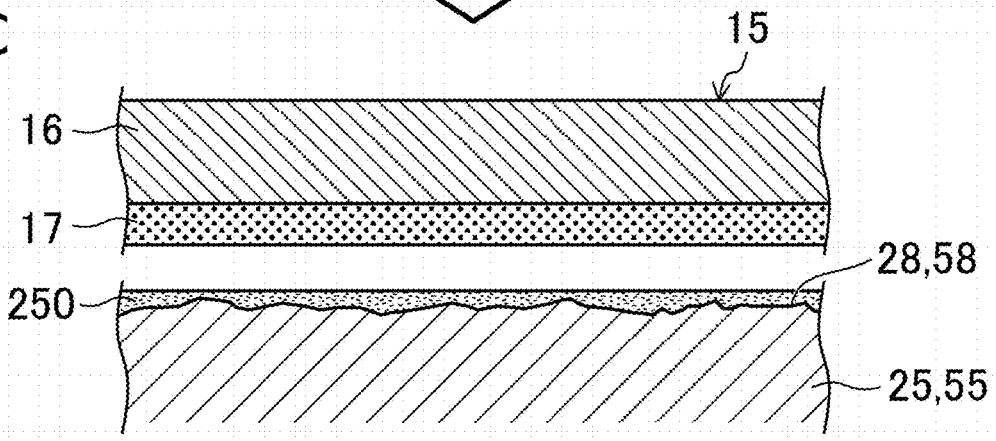

As illustrated in FIG. 10C, in the adhering step (202), the partition sheet (15) is arranged such that the moisture permeable layer (17) faces the joining surface (28, 58) of the frame (25, 55). In the adhering step (202), the partition sheet (15) with this arrangement is placed over the joining surface (28, 58) of the frame (25, 55) to which the treatment liquid (250) has been adhered. As a result, the moisture permeable layer (17) of the partition sheet (15) comes into contact with the treatment liquid (250) which has been adhered to the joining surface (28, 58).

As mentioned above, a polymer forming the moisture permeable layer (17) is dissolved in ethanol, which is a main component of the treatment liquid (250). Thus, when the partition sheet (15) is placed over the joining surface (28, 58) of the frame (25, 55) to which the treatment liquid (250) has been adhered, a surface layer portion of an area of the moisture permeable layer (17) facing the joining surface (28, 58) comes into contact with ethanol contained in the treatment liquid (250). As a result, the polymer forming the moisture permeable layer (17) enters fine irregularities formed on the joining surface (28, 58).

Drying Step of Element Assembling Step

Figure 10D:
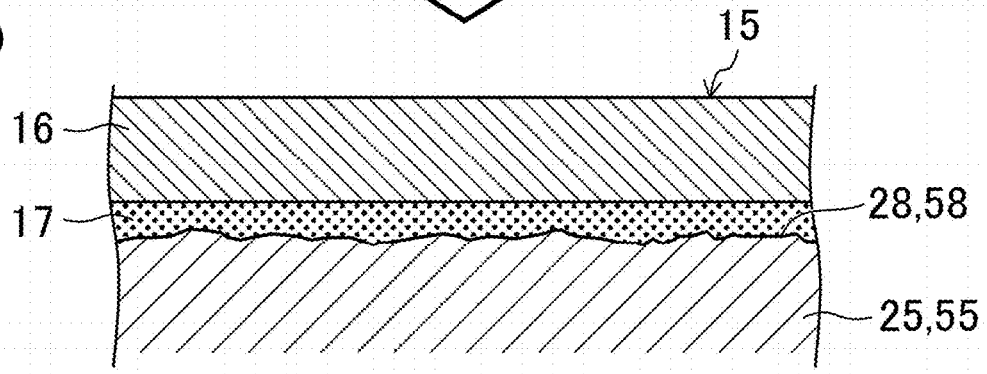

The drying step (203) is a step of evaporating the treatment liquid (250). The drying step (203) is a step of keeping the frame (25, 55) over which the partition sheet (15) has been placed in the adhering step (202) at room temperature for a predetermined period of time. When the treatment liquid (250) evaporates, portion of the moisture permeable layer (17) which as been temporally dissolved in the adhering step (202) is solidified. As a result, as illustrated in FIG. 10D, the surface layer portion of the moisture permeable layer (17) of the partition sheet (15) enters fine irregularities formed on the joining surface (28, 58), and the partition sheet (15) is fixed to the joining surface (28, 58) of the frame (25, 55).

Stacking Step

In the stacking step (210), a plurality of first elements (20) and a plurality of second elements (50) are provided, and are stacked alternately. When the first elements (20) and the second elements (50) are alternately stacked, the partition sheets (15) and the frames (25, 55) are alternately stacked. As a result, a plurality of first passages (21) and a plurality of second passages (51) into which the partition sheets (15) partition are formed.

The first elements (20) and the second elements (50) stacked are fixed to each other to form a stack. In the stack, the elements (20, 50) stacked are fixed to each other with bolts penetrating the elements (20, 50) in the stacking direction and nuts attached to the bolts. The bolts and nuts are not shown.

Sealing Step

In the stack formed in the stacking step (210), corresponding notches (38, 68) provided in the frames (25, 55) of the elements (20, 50) are aligned in a row in the stacking direction of the elements (20, 50).

In the sealing step (211), an operation of filling the notches (38, 68) aligned in a row with a filler having fluidity is performed. The filler having fluidity may be a fluid having a relatively high viscosity such as a silicon sealing agent.

Next, in the sealing step (211), an operation of solidifying the filler with which the notches (38, 68) have been filled is performed. In this operation, the stack which has undergone the filling is heated for a predetermined period of time, or kept at room temperature for a predetermined period of time in order to vaporize a solvent component contained in the filler. As a result, the filler with which the notches (38, 68) are filled is solidified to form seals (81).

Joining State of Partition Sheet

As illustrated in FIG. 10D, the surface layer portion of the moisture permeable layer (17) of the partition sheet (15) enter fine irregularities formed on the joining surface (28, 58), and the partition sheet (15) is fixed to the joining surface (28, 58) of the frame (25, 55). Accordingly, the partition sheet (15) is joined to the frame (25, 55) with the moisture permeable layer (17) directly in contact with the frame (25, 55).

As described above, in the element (20, 50) of this embodiment, the partition sheet (15) is joined directly to the frame (25, 55) without an adhesive intervened therebetween. In each element (20, 50), the moisture permeable layer (17) of the partition sheet (15) comes into direct contact with the frame (25, 55), whereas the porous base (16) of the partition sheet (15) does not come into contact with the frame (25, 55).

A joining strength of the partition sheet (15) to the frame (25, 55) is a joining strength at which the partition sheet (15) is not broken when the partition sheet (15) is peeled off from the frame (25, 55). The joining strength of the partition sheet (15) to the frame (25, 55) is lower than the breaking strength of the partition sheet (15).

Breaking Strength

The breaking strength P1 of the partition sheet (15) is a pressure which acts on the partition sheet (15) when it is broken in a test based on the testing method B for water resistance defined in Japanese Industrial Standard (JIS L 1092:2009).

Joining Strength

The joining strength P2 of the partition sheet (15) to the frame (25, 55) is determined by a test using the element (20, 50) of this embodiment.

Figure 11:
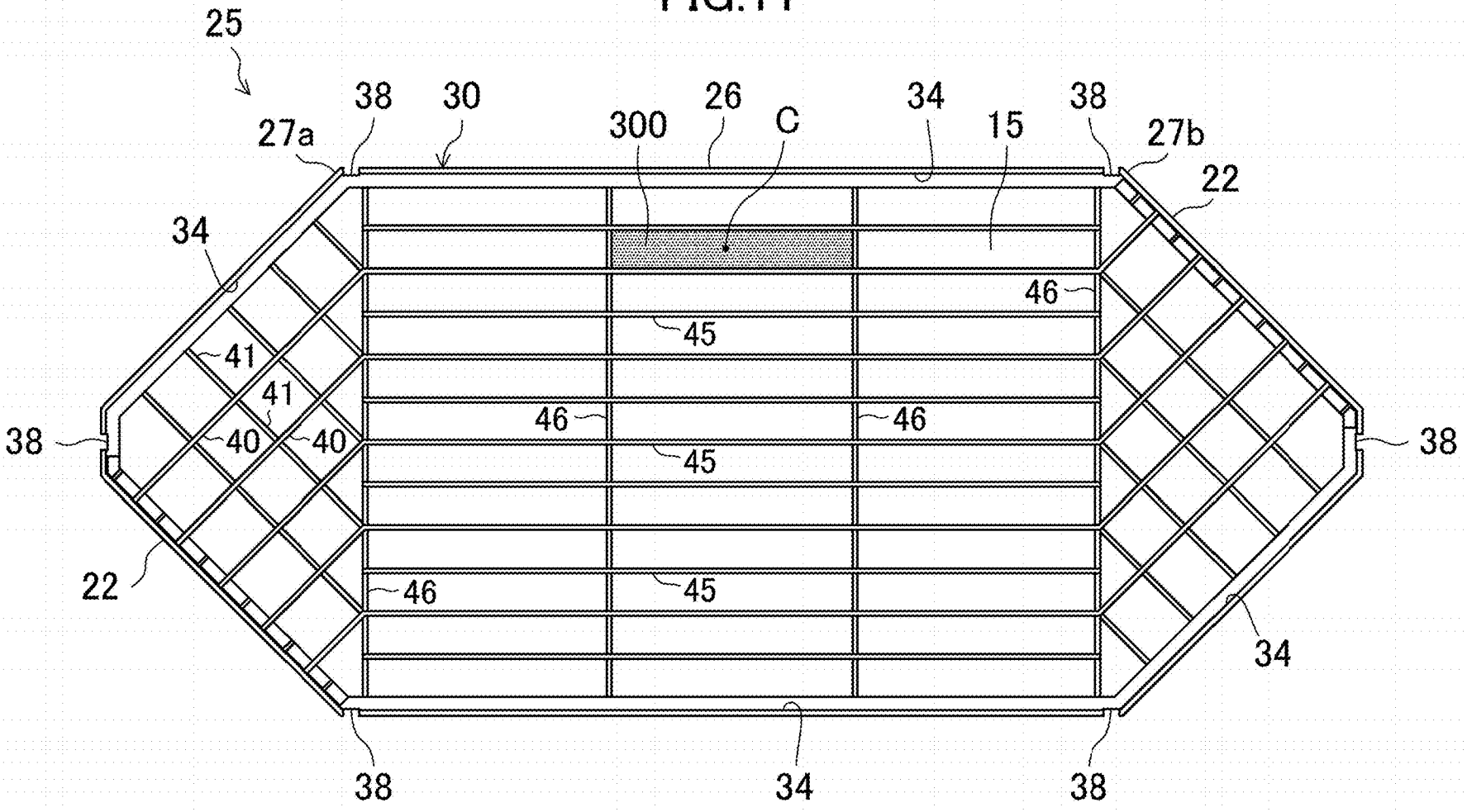
FIG. 11 is a plan view of a first element showing a method for measuring a joining strength of the partition sheet to the frame.

The test for determining the joining strength P2 will be described below with reference to FIG. 11. Although the test using the first element (20) will be described herein, the test may be performed using the second element (50).

An area of the partition sheet (15) surrounded by the intra-first passage ribs (45) and the first support ribs (46) is defined as a target area (300). A force is applied to the center point C of the target area, and a force F when the partition sheet (15) is peeled off from the intra-first passage ribs (45) or the first support ribs (46) is measured. The joining strength P2 is calculated by dividing the force F by the area A of the target area (300) (P2=F/A).

Relationship Between Breaking Strength and Joining Strength

In the element (20, 50) of this embodiment, the joining strength P2 of the partition sheet (15) to the frame (25, 55) is smaller than the breaking strength P1 of the partition sheet (15). The joining strength P2 of the partition sheet (15) to the frame (25, 55) is desirably 75% or less, more desirably 50% or less of the breaking strength P1 of the partition sheet (15).

Feature (1) of Embodiment

When the partition sheet (15) is joined to the frame (25, 55) with an adhesive in the element (20, 50), the adhesive may spread beyond the joining portion between them. If the adhesive which has been spread beyond the joining portion between them covers the partition sheet (15), the adhesive hinders the movement of heat and moisture from one of the supply air or the exhaust air to the other.

On the other hand, in each element (20, 50) of this embodiment, the partition sheet (15) is joined to the frame (25, 55) in direct contact. Thus, the portion of the partition sheet (15) that is in contact with the air flowing through the air flow path (21, 51) is larger than that in the case where the partition sheet (15) is adhered to the frame (25, 55) with an adhesive, thereby improving the heat exchange performance of the heat exchanger (10).

Feature (2) of Embodiment

In each element (20, 50) of this embodiment, the partition sheet (15) is joined to a flat joining surface (28, 58) formed on the frame (25, 55). Thus, adhesion of the partition sheet (15) to the frame (25, 55) becomes high, so that the joining strength of the partition sheet (15) to the frame (25, 55) becomes high.

Feature (3) of Embodiment

In the element (20, 50) of this embodiment, the joining strength P2 of the partition sheet (15) to the frame (25, 55) is smaller than the breaking strength P1 of the partition sheet (15). Thus, the partition sheet (15) can be peeled off from the frame (25, 55) without breaking the partition sheet (15). As a result, the work of separating the partition sheet (15) and the frame (25, 55) from each other when the heat exchanger (10) is discarded is facilitated.

If the partition sheet (15) is bonded to an inappropriate position of the frame (25, 55) in the element assembling step (200), the partition sheet (15) can be once removed from the frame (25, 55), and the removed partition sheet (15) can be re-adhered to the frame (25, 55). As a result, it is possible to reduce materials discarded due to an operation error in the process of manufacturing the heat exchanger (10).

Feature (4) of Embodiment

In the element assembling step (200) of the method for manufacturing the heat exchanger (10) of this embodiment, portion of the moisture permeable layer (17) forming the partition sheet (15), facing the frame (25, 55) is temporally dissolved, and then, the portion of the moisture permeable layer (17) which has been temporally dissolved is solidified, so that the partition sheet (15) is fixed to the frame (25, 55) without an adhesive intervened therebetween. Thus, according to this embodiment, the partition sheet (15) can be joined to the frame (25, 55) without an adhesive.

Feature (5) of Embodiment

In the element assembling step (200) of the method for manufacturing the heat exchanger (10) of this embodiment, the moisture permeable layer (17) forming the partition sheet (15) is temporally dissolved by the treatment liquid (250) containing a second substance as a main component.

The ethanol is a main component of a solvent composing a raw material liquid used to form the moisture permeable layer (17). Thus, even when the moisture permeable layer (17) is temporally dissolved and then solidified to fix the partition sheet (15) to the frame (25, 55), the moisture permeable layer (17) is not deteriorated. Accordingly, the partition sheet (15) can be joined to the frame (25, 55) without deterioration of the moisture permeability of the partition sheet (15), thereby keeping the performance of the heat exchanger (10) from decreasing.

Here, the solvent which is a component of the commonly used adhesive contains a substance which gradually volatilizes over a long period of time. Thus, when the heat exchanger is attached to the ventilator, the solvent contained in the adhesive evaporates and flows into the room with the air, and the smell of the solvent may impair the comfort of the indoor space.

In contrast, ethanol, which is a main component of the treatment liquid (250) used in the element assembling step (200) of this embodiment is a highly volatile substance. Thus, ethanol remaining in the element (20, 50) assembled in the element assembling step (200) substantially completely evaporates in a relatively short time. Therefore, when the heat exchanger (10) is attached to the ventilator (100), ethanol is substantially not present in the heat exchanger (10), and the comfort of the indoor space is not impaired by the smell of ethanol.

First Variation of Embodiments

In the element assembling step (200) of the method for manufacturing the heat exchanger (10) of this embodiment, the partition sheet (15) may be joined to the frame (25, 55) by insert molding.

In such a case, in the element assembling step (200), an element (20, 50) in which the partition sheet (15) is joined to the frame (25, 55) is manufactured by injecting molten resin into a mold for injection molding in which the partition sheet (15) is disposed in advance. Also in the element (20, 50) manufactured in the element assembling step (200) of this variation, as in the element (20, 50) shown in FIG. 7, one surface of the partition sheet (15) is only joined to the frame (25, 55).

Second Variation of Embodiments

In the element assembling step (200) of the method for manufacturing the heat exchanger (10) of this embodiment, the partition sheet (15) may be joined to the frame (25, 55) by thermal welding.

In such a case, in the element assembling step (200), the partition sheet (15) is kept at a predetermined temperature (e.g., 120° C.) for a predetermined time (e.g., 25 seconds) in a state of being in close contact with the joining surface (28, 58) of the frame (25, 55). As a result, portion of the moisture permeable layer (17) of the partition sheet (15) is temporally dissolved or softened, and the dissolved or softened portion of the moisture permeable layer (17) enters fine irregularities of the joining surface (28, 58). Then, when the partition sheet (15) is cooled to solidify the moisture permeable layer (17), the partition sheet (15) is fixed to the joining surface (28, 58) of the frame (25, 55).

Further, in the element assembling step (200) of this embodiment, the partition sheet (15) may be joined to the frame (25, 55) by welding other than the thermal welding. Examples of the welding other than the thermal welding include high-frequency welding, ultrasonic welding, and laser welding.

When the partition sheet (15) is joined to the frame (25, 55) by high-frequency welding, portion of the moisture permeable layer (17) of the partition sheet (15) is dissolved or softened by irradiation with high-frequency waves (electromagnetic waves) of about several tens of MHz.

When the partition sheet (15) is joined to the frame (25, 55) by ultrasonic welding, portion of the partition sheet (15) which comes into contact with the frame (25, 55) is irradiated with ultrasonic waves to dissolve or soften portion of the moisture permeable layer (17) of the partition sheet (15) by frictional heat generated.

When the partition sheet (15) is joined to the frame (25, 55) by laser welding, portion of the moisture permeable layer (17) of the partition sheet (15) is dissolved or softened by irradiation with laser.

Third Variation of Embodiments

The shape of the heat exchanger (10) of the above embodiment is not limited to an octagonal prism. The shape of the heat exchanger (10) may be, for example, a hexagonal prism or a quadrangular prism.

While the embodiments and variations thereof have been described above, it will be understood that various changes in form and details may be made without departing from the spirit and scope of the claims. The elements according to embodiments, the variations thereof, and the other embodiments may be combined and replaced with each other. In addition, the expressions of "first," "second," "third," . . . , in the specification and claims are used to distinguish the terms to which these expressions are given, and do not limit the number and order of the terms.

As can be seen from the foregoing description, the present disclosure is useful for a heat exchanger, a ventilator, and a method for manufacturing the heat exchanger.

The invention claimed is:

1. A heat exchanger comprising:

a plurality of flow pass elements, each flow pass element including a partition member that is a moisture permeable sheet shaped member, and a frame forming an air flow path by joining to the partition member, the heat exchanger being configured by stacking the plurality of flow pass elements, and in each of the plurality of flow pass elements, the partition member being joined to the frame in direct contact, a joining strength of the partition member to the frame being smaller than a breaking strength of the partition member.

2. The heat exchanger of claim 1, wherein the partition member includes a porous base that is sheet shaped, and a moisture permeable layer covering a surface of the porous base, the moisture permeable layer of the partition member faces the frame, and among the porous base and the moisture permeable layer, only the moisture permeable layer is in direct contact with the frame.

3. The heat exchanger of claim 1, wherein a flat joining surface is provided on the frame, and the partition member is joined to the flat joining surface.

4. A heat exchanger comprising:

a plurality of flow pass elements, each flow pass element including a partition member that is a moisture permeable sheet shaped member, and a frame forming an air flow path by joining to the partition member, the heat exchanger being configured by stacking the plurality of flow pass elements, in each of the plurality of flow pass elements, the partition member being joined to the frame in direct contact, a joining strength of the partition member to the frame being such that the partition member is not broken when the partition member is peeled off from the frame.

5. The heat exchanger of claim 1, wherein the partition member is joined to the frame by entering fine irregularities on a surface of the frame.

6. A ventilator including the heat exchanger of claim 1, the ventilator being configured to cause the heat exchanger to exchange heat between supply air supplied into a room from outside and exhaust air exhausted out of the room from inside.

7. The heat exchanger of claim 4, wherein the partition member includes a porous base that is sheet shaped, and a moisture permeable layer covering a surface of the porous base, the moisture permeable layer of the partition member faces the frame, and among the porous base and the moisture permeable layer, only the moisture permeable layer is in direct contact with the frame.

8. The heat exchanger of claim 4, wherein a flat joining surface is provided on the frame, and the partition member is joined to the flat joining surface.

9. The heat exchanger of claim 4, wherein the partition member is joined to the frame by entering fine irregularities on a surface of the frame.

* * * * *